US006012255A

United States Patent [19]

Smid et al.

[11] Patent Number: 6,012,255

[45] Date of Patent: Jan. 11, 2000

[54] CONSTRUCTION BOARD HAVING A NUMBER OF MARKS FOR FACILITATING THE INSTALLATION THEREOF AND A METHOD FOR FABRICATING SUCH CONSTRUCTION BOARD

[76] Inventors: Dennis M. Smid, 9 Karen Ct., Wayne; Richard Palmesino, 28 Dowling Pkwy., West Paterson, both of N.J.

[21] Appl. No.: 09/049,764

[22] Filed: Mar. 27, 1998

Related U.S. Application Data

[60] Provisional application No. 60/058,188, Sep. 8, 1997.

[51] Int. Cl.[7] ..... E04B 2/00

[52] U.S. Cl. ..... 52/105; 52/745.19

[58] Field of Search ..... 52/105, 745.19; 428/195, 537.1, 537.5, 537.7

[56] References Cited

U.S. PATENT DOCUMENTS

| | | | |
|---|---|---|---|
| 2,270,419 | 1/1942 | Debo | 52/105 |
| 4,725,477 | 2/1988 | Kole et al. . | |
| 4,858,402 | 8/1989 | Putz | 52/105 |
| 4,870,788 | 10/1989 | Hassan | 52/105 |
| 4,927,696 | 5/1990 | Berg | 52/105 X |
| 5,045,378 | 9/1991 | Libby . | |
| 5,477,784 | 12/1995 | Floegel . | |

*Primary Examiner*—Christopher T. Kent
*Attorney, Agent, or Firm*—Frommer Lawrence & Haug LLP; Dennis M. Smid

[57] ABSTRACT

A construction board having a number of marks or lines which facilitate the installation of such board to a number of supports in a building, house or the like. Such lines may have a number of different arrangements. For example, the lines may be arranged as a plurality of substantially horizontal and/or vertical lines which have a predetermined distance or distances therebetween. Such distance or distances may correspond to the standard spacing between supports (such as 16 or 24 inches). Alternatively the spacing between lines may have a relatively small value, such as ½ of an inch, 1 inch, 1½ inches, 2 inches or the like. Additionally, adjacent lines may have respective characteristics (such as different colors) so as to easily distinguish between adjacent lines. As a result, a worker may easily install a construction board in a relatively small amount of time and the number of fasteners (nails, screws, or the like) which "miss" a support member may be eliminated or reduced.

21 Claims, 7 Drawing Sheets

CONSTRUCTION BOARD HAVING A NUMBER OF MARKS FOR FACILITATING THE INSTALLATION THEREOF AND A METHOD FOR FABRICATING SUCH CONSTRUCTION BOARD

CROSS REFERENCE TO RELATED APPLICATION

This application is based upon a provisional application Serial No. 60/058,188, filed Sep. 8, 1997.

BACKGROUND OF THE INVENTION

The present invention relates to a technique for facilitating the installation of construction boards (such as gypsum board, plywood, or the like) to supporting members and, more particularly, to such technique wherein markings are provided on such boards which may indicate the locations of such supporting members.

In constructing a house, office building, or the like, various types of construction boards, such as gypsum board, plywood and the like, may be utilized in forming walls, ceilings, floors, roofs and so forth. Such types of constructing boards are normally provided in relatively large sizes (such as 4'×8', 4'×10', 4'×12', and so forth) and are typically attached to so-called studs, joists, rafters or the like (hereinafter, referred to as "supports" or "support members"), which may be formed of wood or metal, by use of nails, screws or other types of fasteners. For example, as shown in FIG. 1, a construction board 2 (which may be a gypsum board/ may be attached to a plurality of studs or supports 1 by use of a plurality of nails or screws 3.

Since each piece of gypsum board, plywood, or the like is relatively large, such piece may cover or hide from view a relatively large portion or portions of the respective supports to which it is to be attached. As a result, it may be difficult for a worker to locate the respective supports so as to attach such piece of gypsum board or plywood to such supports.

As is to be appreciated, the above-described arrangement may cause a worker to need a relatively large amount of time to attach a piece of gypsum board or plywood or the like to the respective supports. Additionally, in such arrangement, the worker may not properly secure the piece of gypsum board, plywood or the like to the supports with each fastener. That is, one or more of such fasteners may "miss" the respective support, such as fasteners 4 shown in FIG. 1.

OBJECTS AND SUMMARY OF THE INVENTION

An object of the present invention is to provide a technique wherein markings or lines are placed on a construction board (such as gypsum board, plywood, or the like, so as facilitate the installation of such construction board to supports.

Another object of the present invention is to provide a technique as aforesaid wherein the markings or lines are horizontal and/or vertical lines which are arranged at predetermined intervals.

A further object of the present invention is to provide a technique as aforesaid wherein the predetermined intervals correspond to standard intervals between supports (such as 16 inches or 24 inches) or wherein the predetermined intervals have a relatively small value (such as ½, 1, or 1½ inches) and in which alternating lines may have distinguishing characteristics (such as different colors, types of marks, and so forth, so as readily distinguish between adjacent lines.

In accordance with an aspect of the present invention, a construction board (such as a piece of gypsum board, plywood or so forth) adapted to be attached to a number of supports in a building, house or the like, is provided wherein the construction board has at least two sides in which at least one of the sides includes a number of marks for facilitating the attaching of the construction board to the number of supports.

Other objects, features and advantages according to the present invention will become apparent from the following detailed description of the illustrated embodiments when read in conjunction with the accompanying drawings in which corresponding components are identified by the same reference numerals.

DESCRIPTION OF THE PREFERRED EMBODIMENTS

Preferred embodiments of the present invention will now be described with reference to the accompanying drawings.

FIGS. 2A, 2B, 2C, 2D, 2E, and 2F illustrate construction boards having markings thereon for facilitating the installation of such boards to supports. Each of such construction boards will now be more fully described.

Figure 1:
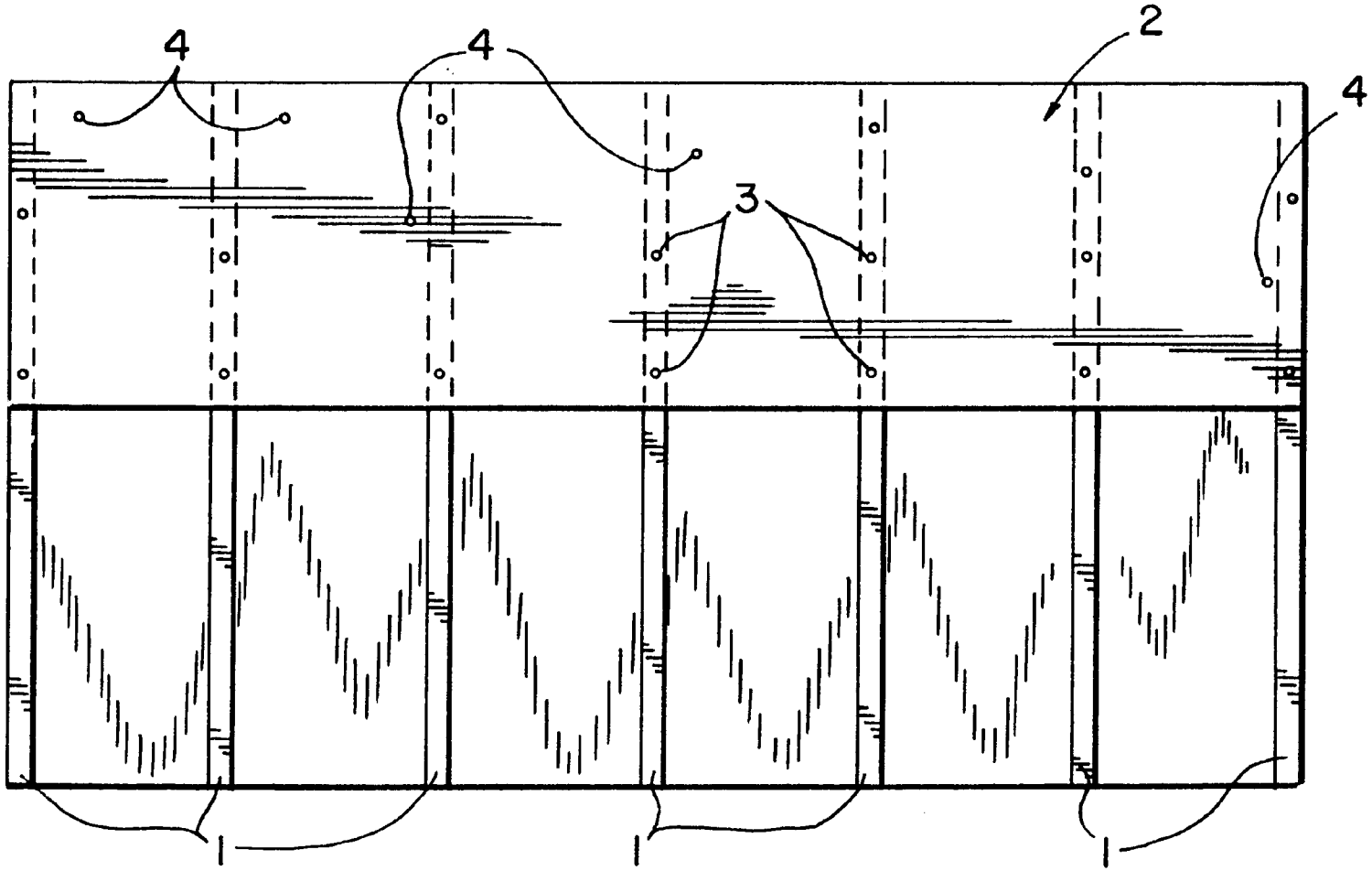
FIG. 1 illustrates a diagram to which reference will be made in explaining the installation of a conventional construction board.
Figure 2A:
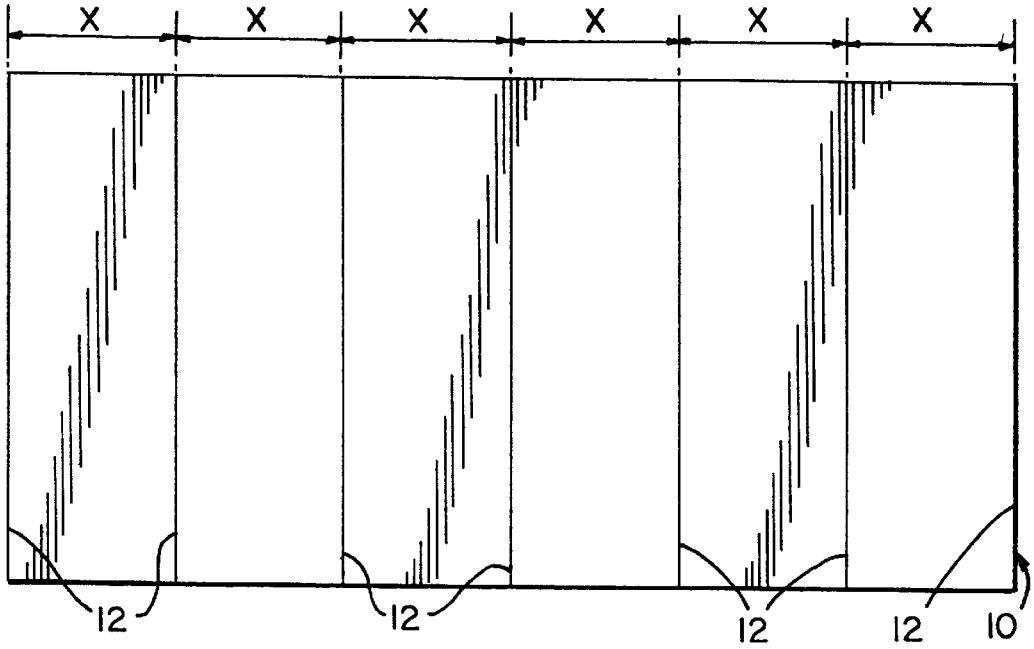
FIG. 2A is diagram of a construction board according to an embodiment of the present invention.

In FIG. 2A, a construction board 10 is shown which has a plurality of marks or vertical lines 12 each having a predetermined distance X therebetween. Such predetermined distance X may correspond to a standard spacing between supports which, for example, may have a value of 16 inches. Accordingly, in such situation, if the construction board 10 has a size of 4'×8', such board may have five lines 12 which are respectively spaced at 16, 32, 48, 64, and 80 inches from an edge A of the board. Alternatively, the predetermined distance X may have other values such as 24 inches wherein a 4'×8' construction board would have three lines respectively spaced at 24, 48, and 72 inches from the edge A of the board.

Figure 2B:
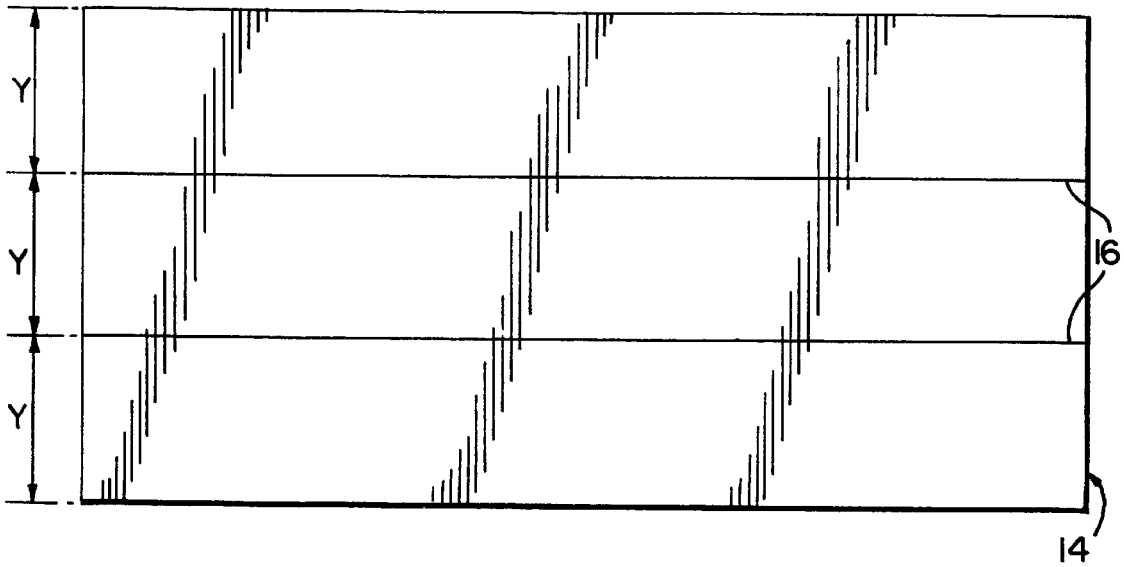
FIG. 2B is diagram of a construction board according to another embodiment of the present invention.

In FIG. 2B, a construction board 14 is shown which has a plurality of marks or horizontal lines 16 each having a predetermined distance Y therebetween. Such predetermined distance Y may correspond to a standard spacing between supports which, for example, may have a value of 16 inches. Accordingly, in such situation, if the construction board 14 has a size of 4'×8', such board may have two lines 16 which are respectively spaced at 16 and 32 inches from an edge B of the board. Alternatively, the predetermined distance Y may have other values such as 24 inches wherein a 4'×8' construction board would have one line located at 24 inches from the edge B of the board.

Figure 2C:
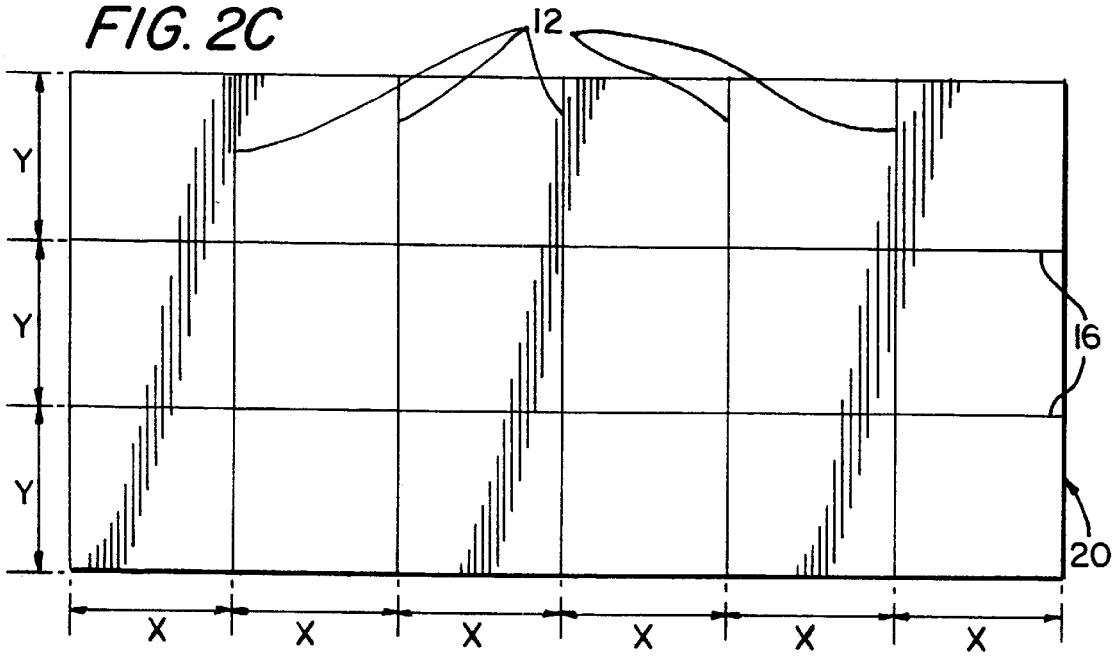
FIG. 2C is diagram of a construction board according to another embodiment of the present invention.

In FIG. 2C, a construction board 20 is shown which has a plurality of marks or vertical lines 12 each having a predetermined distance X therebetween and a plurality of marks or horizontal lines 16 each having a predetermined distance Y therebetween. Such predetermined distances X and Y may correspond to a standard spacing between supports which, for example, may have a value of 16 inches or, alternatively, either of the predetermined distances X and Y may have other values such as 24 inches, in a manner similar to that previously described.

Figure 2D:
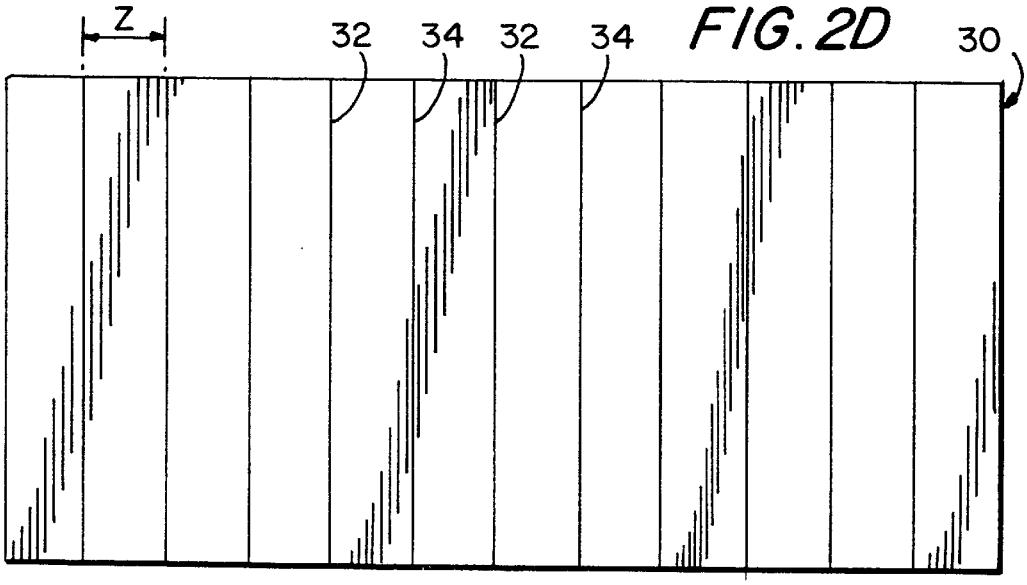
FIG. 2D is diagram of construction board according to another embodiment of the present invention.

In FIG. 2D, a construction board 30 is shown which has a plurality of marks or vertical lines 32 and 34 each having a predetermined distance Z therebetween. Such predetermined distance Z may have a relatively small value, such as ½ of an inch, 1 inch, 1½ inches or the like. As is to be appreciated, during installation, each line 32 or 34 may not correspond to a support member. Nevertheless, such arrangement may facilitate the installation of the construction board 30 to support members in that once a worker locates a respective support member, the worker may utilize or follow the one or ones of the lines 32 and 34 closest to the respective support member in securing the board to the support member. Additionally, the lines 32 and 34 may have respectively different features so as to distinguish between adjacent lines and aid a worker in utilizing or following a respective line. For example, the lines 32 may have a first color (such as red) and the lines 34 may have a second color (such as blue). As another example, the lines 32 may be solid or continuous type lines, whereas the lines 34 may be dotted or dashed type lines.

Figure 2E:
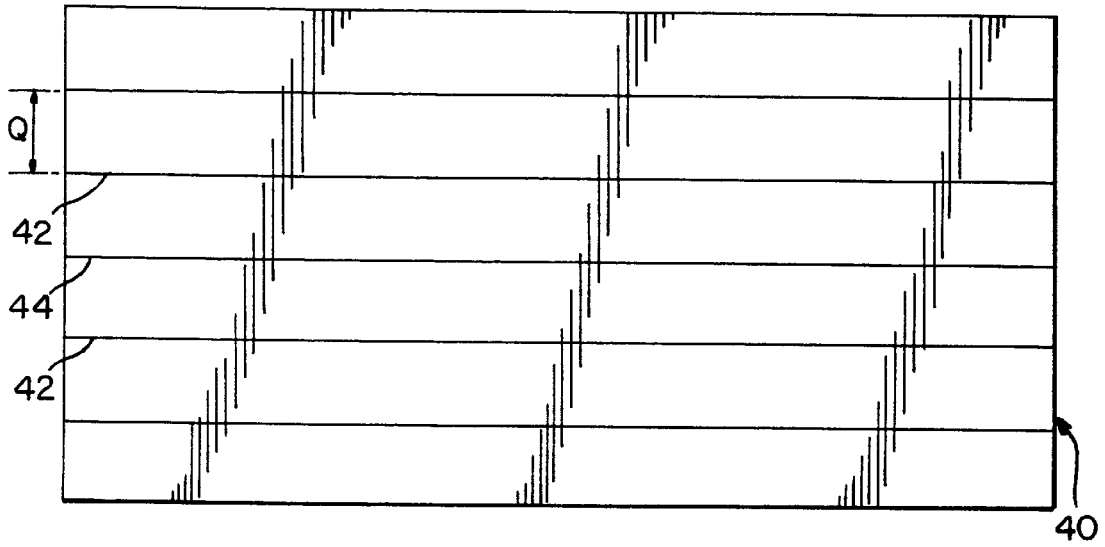
FIG. 2E is diagram of construction board according to another embodiment of the present invention.

In FIG. 2E, a construction board 40 is shown which has a plurality of marks or horizontal lines 42 and 44 each having a predetermined distance Q therebetween. Such predetermined distance z may have a relatively small value, such as ½ of an inch, 1 inch, 1½ inches or the like. In a manner similar to that previously described with regard to FIG. 2D, during installation, each line 42 or 44 may not correspond to a support member. Nevertheless, such arrangement may facilitate the installation of the construction board 40 to support members in that once a worker locates a respective support member, the worker may utilize or follow the one or ones of the lines 42 and 44 closest to the respective support member in securing the board to the support member. Additionally, the lines 42 and 44 may have respectively different features so as to distinguish between adjacent lines and aid a worker in utilizing or following a respective line. For example, the lines 42 may have a first color (such as red) and the lines 44 may have a second color (such as blue). As another example, the lines 42 may be solid or continuous type lines, whereas the lines 44 may be dotted or dashed type lines.

Figure 2F:
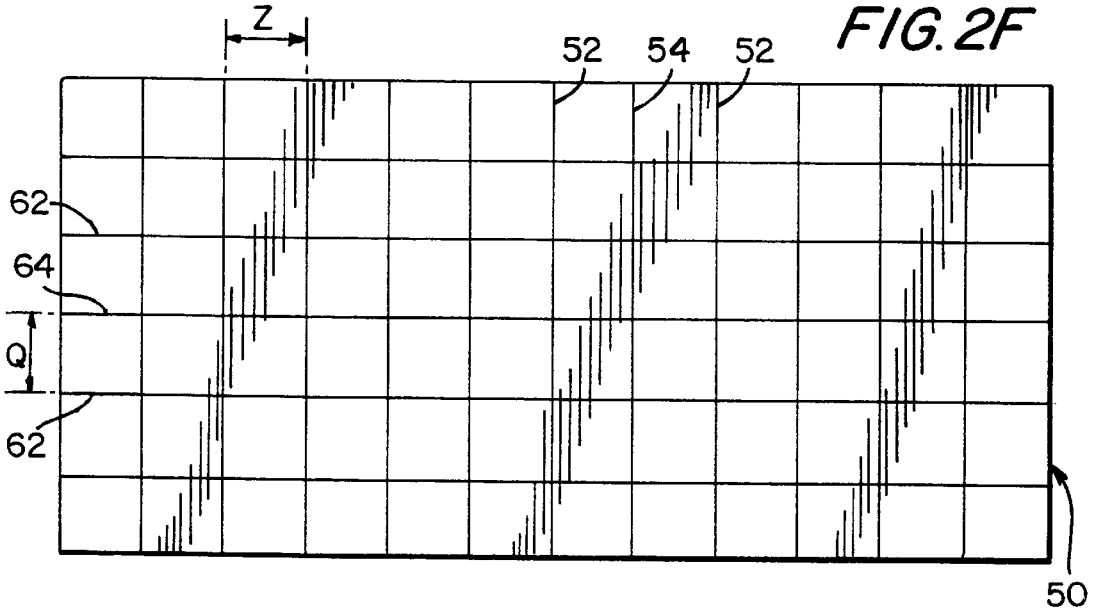
FIG. 2F is diagram of construction board according to another embodiment of the present invention.

In FIG. 2F, a construction board 50 is shown which has a plurality of marks or vertical lines 52/54 each having a predetermined distance Z therebetween and a plurality of marks or horizontal lines 62/64 each having a predetermined distance Q therebetween. Such predetermined distances Z and Q may have relatively small values, such as ½ of an inch, 1 inch, 1½ inches or the like in a manner similar to that previously described with reference to FIGS. 2D and 2E. Further, the distances Z and Q may have the same value or, alternatively, may have different values. For example, Z may have a value of 1 inch and Q may have a value of ½ inch. Also, in a manner similar to that previously described, the vertical lines 52 and 54 and the horizontal lines 62 and 64 may have respectively different features so as to distinguish between adjacent lines and aid a worker in utilizing or following a respective line in securing the board to a support member. For example, the lines 52 and 62 may have a first color (such as red; and the lines 54 and 64 may have a second color (such as blue). As another example, the lines 52 and 62 may be solid or continuous type lines, whereas the lines 54 and 64 may be dotted or dashed type lines.

Figure 3A:
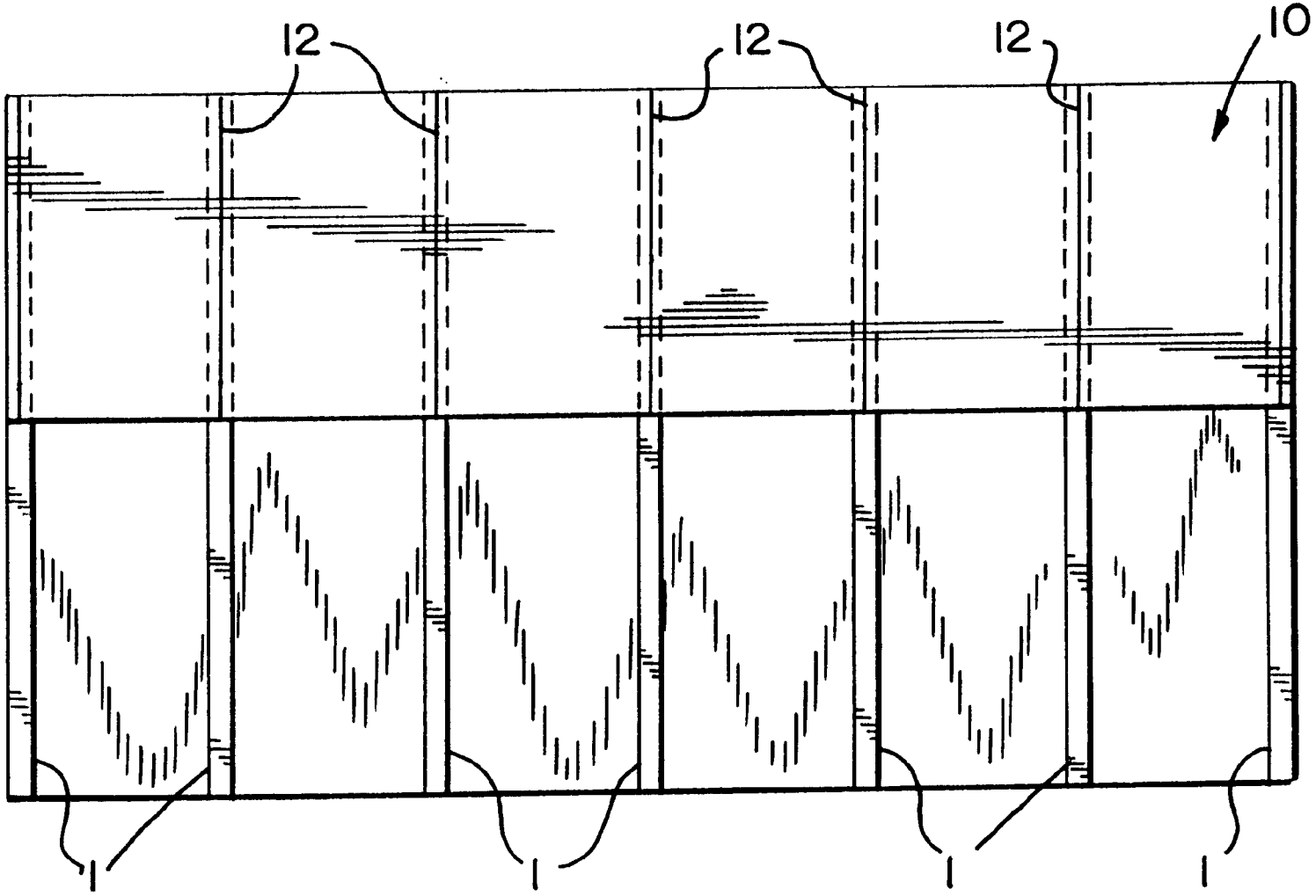
FIGS. 3A and 3B are diagrams to which reference will be made in explaining the installation of the present construction boards of FIGS. 2A and 2B.
Figure 3B:
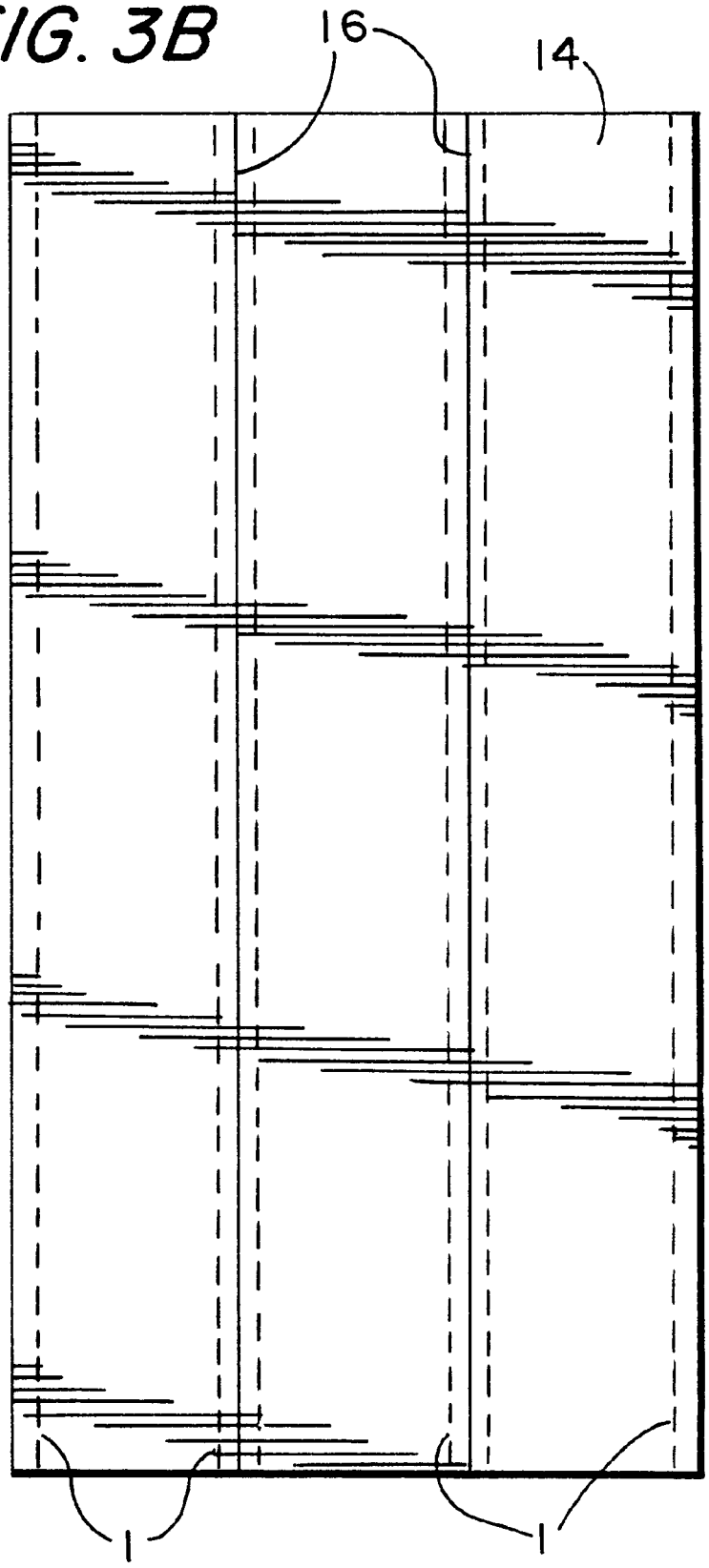

As an example of how the above-described lines may facilitate the installation of a construction board reference is made to FIGS. 3A and 3B wherein the construction boards 10 and 14 are being respectively attached to the supports 1. As shown therein, when the boards 10 and 14 are being attached to the supports, the lines 12 and 16 may correspond to the locations of the supports 1. As a result, a worker or installer may be provided with an easy to follow indication of the locations of the supports 1. As is to be appreciated, such easy to follow indications may reduce the number of nails, screws or other fasteners which "miss" the supports, thereby reducing the time needed for a worker to properly install the construction board.

Figure 4A:
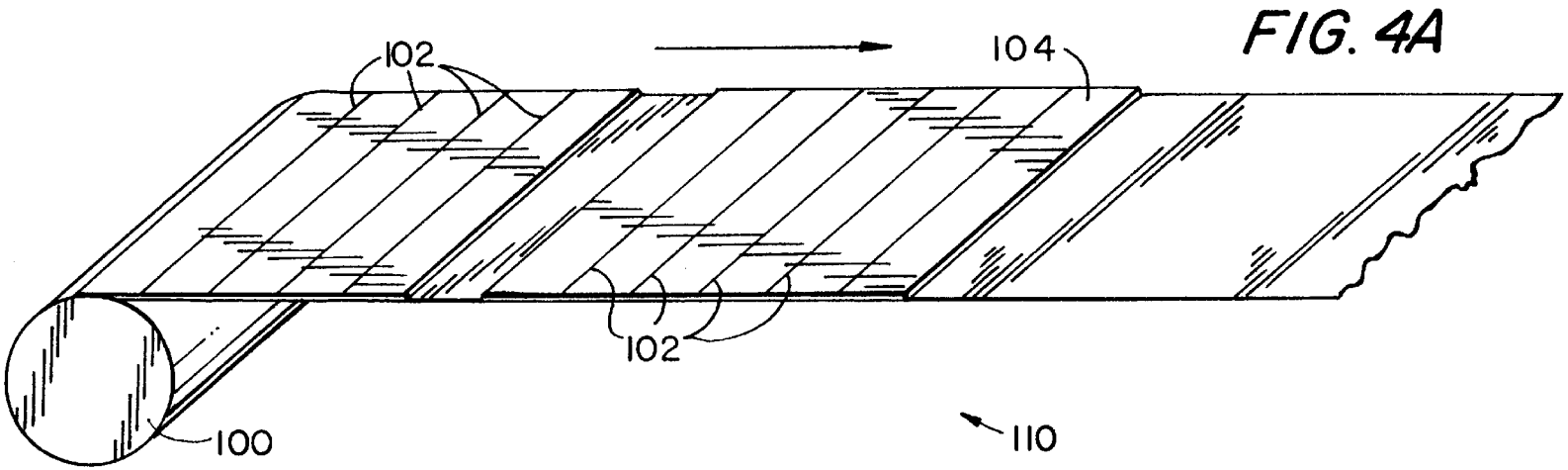
FIGS. 4A and 4B are diagrams illustrating systems for placing lines or marks on a construction board.
Figure 4B:
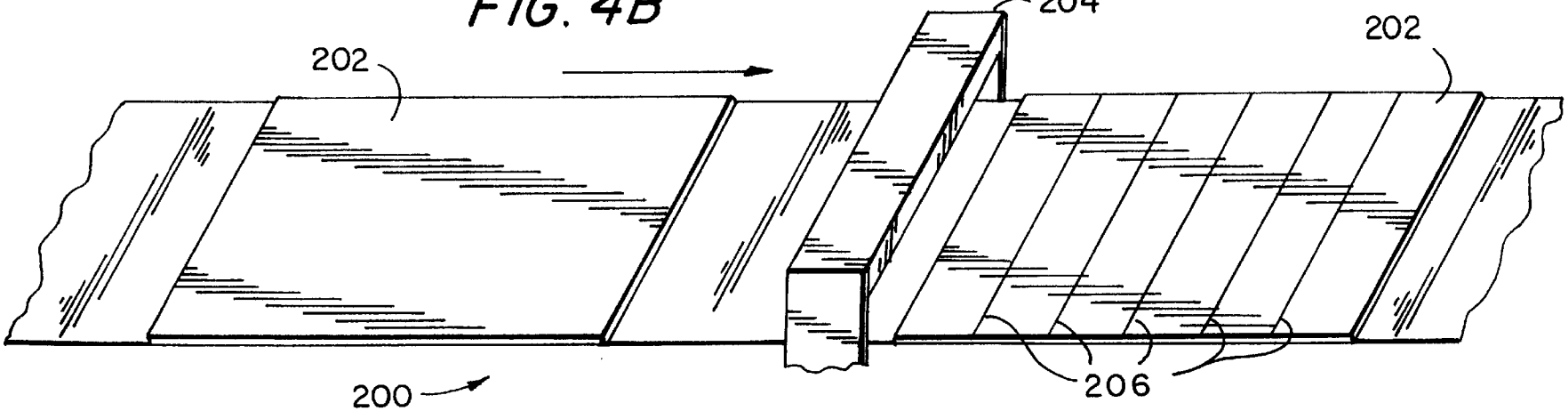

The above-described lines or markings on the construction boards may be installed thereon at the time of fabrication of such construction boards. For example, as shown in FIG. 4A, in a fabrication system 110, a roll of paper 100 used for fabricating a gypsum board 104 may have lines 102 placed thereon prior to the manufacturing of such gypsum board. In this example, such paper may be rolled out during the manufacturing process and the gypsum board is fabricated. Upon completion, the lines 102 are already on the gypsum board 104. Alternately, as shown in FIG. 4B, in a fabrication system 200, lines 206 may be placed on gypsum board or other types of construction boards 202 after completion of such boards. That is, the lines 206 may be added to the construction boards 202 as the last or one of the last steps in the fabrication of such boards by use of a printer-type device 204 or the like.

Thus, the present invention provides a construction board having a number of lines which facilitate the installation of such board to a number of supports in a building, house or the like. Such lines may have a number of different arrangements. For example, the lines may be arranged as a plurality of substantially horizontal and/or vertical lines which have a predetermined distance or distances therebetween. Such distance or distances may correspond to the standard spacing between supports (such as 16 or 24 inches). Alternatively the spacing between lines may have a relatively small value, such as ½ of an inch, 1 inch, 1½ inches, 2 inches or the like. Additionally, adjacent lines may have respective characteristics (such as different colors or types of lines—solid or dotted) so as to easily distinguish between adjacent lines.

By using the present invention, a worker may easily install a construction board in a relatively small amount of time. Additionally, the present invention may reduce or eliminate the number of fasteners (nails, screws, or the like) which "miss" a support member. Further, by reducing the header of such missed fasteners, the present invention may ensure that the construction board is properly installed.

Although in the above description of the present invention, the construction board may have been described as gypsum board, the present invention is not so limited. That is, the present invention may also be applied to other types of construction boards such as plywood, plyscore, particle board, and other types of sheathing material and the like.

Further, although a number of different arrangements of markings or lines for use on construction boards have been described herein, the present invention is not so limited and may be applied to other arrangements of markings or lines for use on construction boards.

Although preferred embodiments of the present invention and modifications thereof have been described in detail herein, it is to be understood that this invention is not limited to these embodiments and modifications, and that other modifications and variations may be effected by one skilled in the art without departing from the spirit and scope of the invention as defined by the appended claims.

What is claimed is:

1. A relatively thin frame covering panel adapted to be attached to a number of supports, said panel having at least two sides in which at least one of said sides includes a number of marks for facilitating the attaching of said panel to said number of supports, wherein said number of marks are arranged in substantially parallel lines having a distance of 2 inches or less therebetween and in which said lines are placed from one end of said panel to an opposite end thereof in a direction transverse to the extent of said lines.

2. A panel according to claim 1, wherein marks of a first set of lines have a first characteristic and marks of a second set of lines have a second characteristic in which each of a plurality of lines in said second set is adjacent on either side to a line in said first set.

3. A panel according to claim 2, wherein the first characteristic is a first color and the second characteristic is a second color.

4. A panel according to claim 2, wherein the first characteristic is a solid line and the second characteristic is a dotted line.

5. A panel according to claim 1, wherein said panel is a piece of gypsum board.

6. A panel according to claim 1, wherein said panel is one of plywood, plyscore, and particle board.

7. A panel according to claim 1, wherein said distance has a value of 1 inch or less.

8. A relatively thin frame covering panel adapted to be attached to a number of supports, said panel having at least two sides in which at least one of said sides includes a number of marks for facilitating the attaching of said panel to said number of supports, wherein said number of marks are arranged in first and second sets of substantially parallel lines in which the lines of the first set have a distance of 2 inches or less therebetween and run in a first direction and are placed from a first end of said panel to a first opposite end thereof in a direction transverse to the extent of said lines of said first set and in which the lines of the second set have a distance of 2 inches or less therebetween and run in a second direction perpendicular to said first direction and are placed from a second end of said panel to a second opposite end thereof in a direction transverse to the extent of said lines of said second set.

9. A relatively thin frame covering panel adapted to be attached to a number of supports, said panel including a side having a number of marks arranged in a plurality of substantially parallel lines in which one or more of said lines being adapted for facilitating the attaching of said panel to said number of supports, wherein said lines have a distance of 2 inches or less therebetween and in which said lines are placed from one end of said panel to an opposite end thereof in a direction transverse to the extent of said lines.

10. A panel according to claim 9, wherein said panel is a piece of gypsum board.

11. A panel according to claim 9, wherein said panel is one of plywood, plyscore, and particle board.

12. A panel according to claim 9, wherein marks of a first set of lines have a first characteristic and marks of a second set of lines have a second characteristic in which each of a plurality of lines in said second set is adjacent on either side to a line in said first set.

13. A panel according to claim 12, wherein the first characteristic is a first color and the second characteristic is a second color.

14. A panel according to claim 12, wherein the first characteristic is a solid line and the second characteristic is a dotted line.

15. A panel according to claim 9, wherein said distance has a value of 1 inch or less.

16. In a method for fabricating a relatively thin frame covering panel adapted to be attached to a number of supports, the improvement comprising the step of fabricating said panel to include a side having a number of marks arranged in a plurality of substantially parallel lines in which one or more of said lines is adapted for facilitating the attaching of said panel to said number of supports and in which said lines have a distance of 2 inches or less therebetween and in which said lines are placed from one end of said panel to an opposite end thereof in a direction transverse to the extent of said lines.

17. A method according to claim 16, wherein said distance has a value of 1 inch or less.

18. A relatively thin frame covering panel adapted to be attached to a number of supports, said panel including a side having a number of marks arranged in first and second sets of substantially parallel lines in which one or more of said lines is adapted for facilitating the attaching of said panel to said number of supports, in which the lines of the first set have a distance of 2 inches or less therebetween and run in a first direction and are placed from a first end of said panel to a first opposite end thereof in a second direction perpendicular to said first direction and in which the lines of the second set have said distance of 2 inches or less therebetween and run in said second direction and are placed from a second end of said panel to a second opposite end thereof in said first direction.

19. A panel according to claim 18, wherein said distance has a value of 1 inch or less.

20. In a method for fabricating a relatively thin frame covering panel adapted to be attached to a number of supports, the improvement comprising the step of fabricating said panel to include a side having a number of marks arranged in first and second sets of substantially parallel lines in which one or more of said lines is adapted for facilitating the attaching of said panel to said number of supports, in which the lines of the first set have a distance of 2 inches or less therebetween and run in a first direction and are placed from a first end of said panel to a first opposite end thereof in a second direction perpendicular to said first direction and in which the lines of the second set have said distance of 2 inches or less therebetween and run in said second direction and are placed from a second end of said panel to a second opposite end thereof in said first direction.

21. A method according to claim 20, wherein said distance has a value of 1 inch or less.

* * * * *